US005103974A

United States Patent [19]

Antonious

[11] Patent Number: 5,103,974

[45] Date of Patent: Apr. 14, 1992

[54] ADJUSTABLE GOLF CLUB HOLDER INSERT

[76] Inventor: Anthony J. Antonious, 7738 Calle Facile, Sarasota, Fla. 34238

[21] Appl. No.: 663,452

[22] Filed: Mar. 4, 1991

[51] Int. Cl.[5] ..... A63B 53/00; A63B 57/00

[52] U.S. Cl. ..... 206/315.6; 206/315.3

[58] Field of Search ..... 206/315.5, 315.6, 315.7, 206/315.3

[56] References Cited

U.S. PATENT DOCUMENTS

| | | | |
|---|---|---|---|
| 936,698 | 10/1909 | Breakspear | 206/315.6 |
| 1,711,344 | 4/1929 | Evans | 206/315.6 |
| 1,849,610 | 3/1932 | Boyce | 206/315.6 |
| 1,876,134 | 9/1932 | Clawson | 206/315.6 |
| 2,568,810 | 9/1951 | Kish, Jr. | 206/315.6 |
| 2,607,382 | 8/1952 | Levine | 206/315.6 |
| 2,752,973 | 7/1956 | Stamp | 206/315.6 |
| 3,053,298 | 9/1962 | Stamp | 206/315.6 X |
| 3,667,078 | 6/1972 | Distasio | 206/315.6 X |
| 4,703,851 | 11/1987 | Stewert | 206/315.6 |
| 4,944,396 | 7/1990 | Larkin | 206/315.6 |

FOREIGN PATENT DOCUMENTS

| | | | |
|---|---|---|---|
| 3132 | of 1912 | United Kingdom | 206/315.6 |
| 324771 | 2/1930 | United Kingdom | 206/315.5 |
| 864624 | 4/1961 | United Kingdom | 206/315.5 |

*Primary Examiner*—Sue A. Weaver

*Attorney, Agent, or Firm*—Nicholas J. Aquilino

[57] ABSTRACT

A golf club holder insert for use with a golf bag having a primary compartment formed of telescoping members which are vertically adjustable with respect to each other to accommodate various sized golf clubs for separating and protecting the club heads and shafts from clubs stored in other compartments in the bag. Various latching mechanisms are disclosed for maintaining the adjustable members in a selected position

9 Claims, 4 Drawing Sheets

ADJUSTABLE GOLF CLUB HOLDER INSERT

BACKGROUND OF THE INVENTION

The present invention relates to golf bags for holding golf clubs and, more particularly, to a golf club holder insert designed to be inserted within the opening of a standard golf bag for holding golf clubs which includes an adjustable sleeve for protecting the shafts of longer golf clubs from damage caused by the heads of the shorter clubs.

Conventional golf bags include various size and shape top dividers which span the opening of the bag for the purpose of separating and dividing the clubs placed in the bag. A general shortcoming of conventional golf bag structures is that the top divider is normally below or at the top edge of the golf bag opening which permits the iron heads of the shorter clubs to impact the hosel and shaft areas of the longer clubs thereby causing damage. This is particularly critical with th.e advent of more sophisticated graphite and titanium shafts some of which use a shaft coating material which can be easily damaged. Some prior art golf bags show top dividers having sections which extend above the bag opening for protection of the shafts as shown in the patents to Evans (U.S. Pat. No. 1,711,344); Boyce (U.S. Pat. No. 1,849,610); Kish (U.S. Pat. No. 2,568,810) and Breakspear (U.S. Pat. No. 936,698) among others.

The present invention relates to a top divider golf club holder insert for golf bags designed to be secured in the opening of a golf bag as original equipment or as a replacement for a standard divider. The insert of the present invention uses a primary compartment which is adjustably moveable relative to the other compartments for separating and protecting the heads and shafts of the golf clubs stored in the primary compartment to prevent damage from the other clubs stored in the bag. The adjustability of the primary compartment permits it to be raised and/or lowered in accordance with the size of the golf clubs carried within the bag. Various embodiments are contemplated wherein the primary compartment may be moved vertically with respect to the other club holding compartments above the bag opening to accommodate the various sized clubs. Among the embodiments are a primary compartment having telescoping members moveable relative to each other using a bayonet type adjustment latch, a spring loaded latch and/or magnetic tape to adjust the height of the telescoping members.

Among the objects of the present invention is the provision of a top divider for separating golf clubs held within the opening of a golf bag including an adjustable primary compartment structured to receive the longer golf clubs and protect them from damage from shorter clubs. Another object of the present invention is to provide a primary golf club holder compartment in the opening of a golf bag which is telescopically adjustable to accommodate a variety of sizes of golf clubs.

These and othe objects will become apparent with reference to the following specification and accompanying drawings.

DESCRIPTION OF THE PREFERRED EMBODIMENTS

Figure 1:
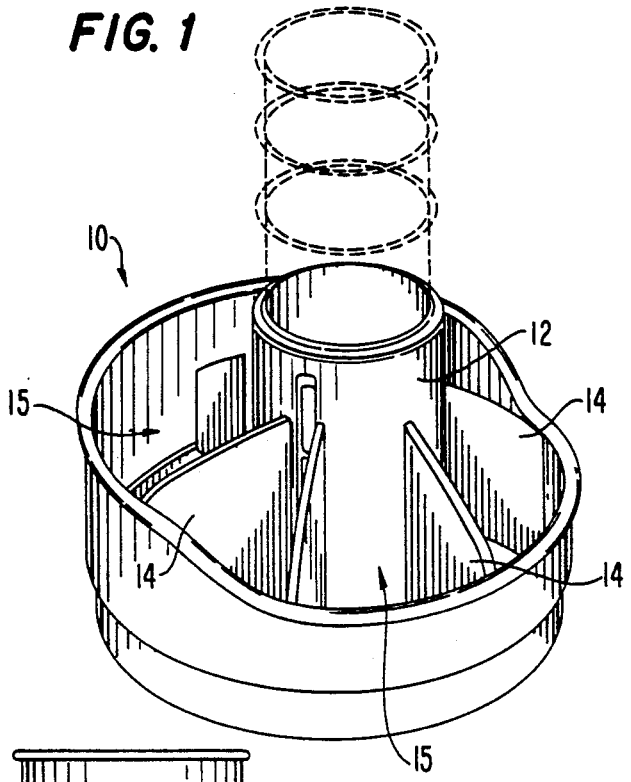
FIG. 1 is a perspective view of a first embodiment of the adjustable golf club holder insert of the present invention.
Figure 2:
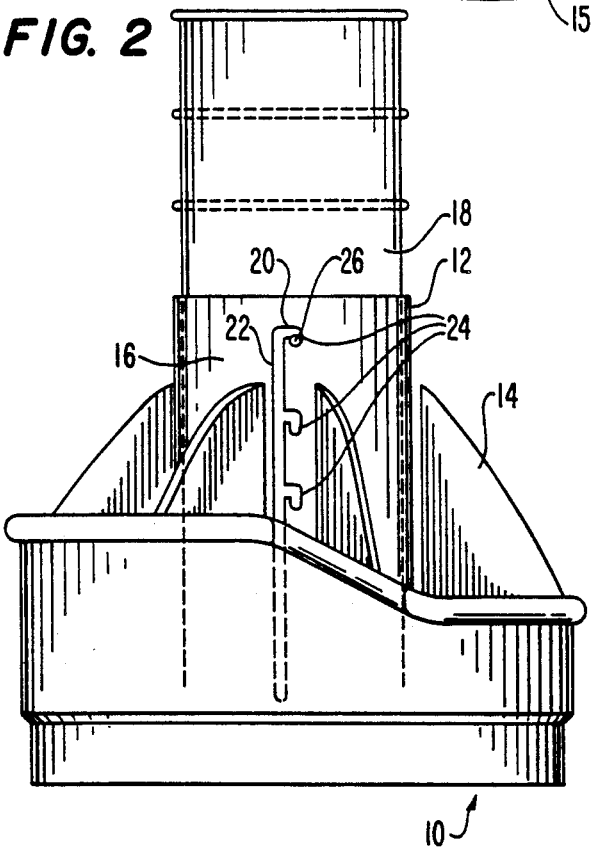
FIG. 2 is a side elevational view of FIG. 1.
Figure 3:
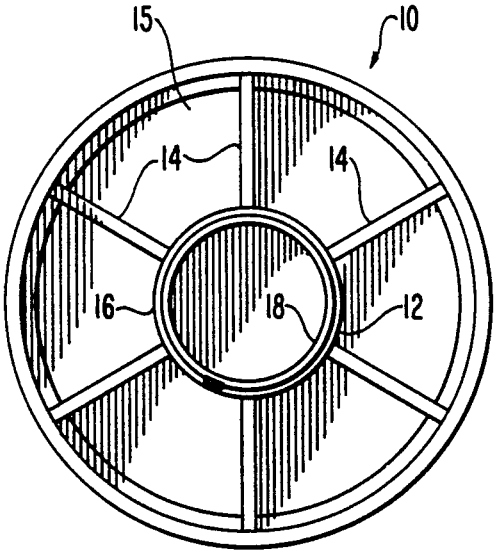
FIG. 3 is a top plan view of FIG. 1.

Referring to FIGS. 1 to 3, a first embodiment of the invention is an insert 10 designed to be inserted into the top opening of a golf bag (not shown) which includes a plurality of compartments for holding golf clubs including a primary central compartment 12 and a plurality of radially disposed compartments 15 which are formed by a plurality of dividers 14. The primary compartment 12 is formed by an outer cylindrical tube 16 and an inner cylindrical tube 18 which are telescopically movable with respect to each other. A bayonet latch 20 includes an elongated slot 22 including a plurality of notches 24 on the outer telescoping tube 16 structured to receive a pin 26 permanently formed on the inner telescoping tube 18.

It will be appreciated that the outer tube 16 is fixed and the inner telescoping tube 18 is vertically adjustable relative to the fixed tube 16 by releasing the bayonet latch 20. A twisting action unlocks the pin 26 from one of the notches 24 permitting the pin 26 to ride within the slot 22 in an up and down direction. When a height which is appropriate for the golf clubs to be held in the bag is reached, pin 26 is locked within the nearest notch 24 by simply twisting in the reverse direction. Thus it can be seen that the inner telescoping tube 18 is freely movable with respect to the outer telescoping tube 16 so that a variety of heights above the bag opening may be achieved by a simple adjustment.

As can be seen the primary compartment 12 extends above the other compartments 15 so that the shorter golf clubs held in the compartments 15 are separated from the shafts and heads of the longer golf clubs held within the primary compartment 12. This prevents damage to these clubs and eliminates the need for special covers or other protective devices. If the golf clubs held in the primary compartment 12 are relatively short, the tube 18 may be telescoped to be coincident with the top of the tube 16.

FIGS. 4–7 illustrate a second embodiment of a golf bag insert 100 including a primary compartment 112 and a plurality of other compartments 115 formed by a series of dividers 114. Whereas in this embodiment the various compartments 115 as shown to be nonsymmetrical, it will be appreciated that any divider structure may be used, either symmetrical or non-symmetrical to provide these compartments 115. The primary compartment 112 is formed with an outer fixed member 116 and an inner telescoping member 118 which is telescopically movable in an up and down or vertical direction with respect to the fixed member 116. The inner member 118 is provided with a plurality of spring latches 120 which are structured to engage the top rim 121 of the outer compartment 116. The latches 120 prevent the telescoping inner member 118 from receding back into the outer member 116 as long as the spring latches engage the top rim 121.

To adjust the height of the compartment 112, the inner member 118 is telescopically moved within the outer member 116 until a desired height is reached. It will be appreciated that as each of the latches 120 passes the upper rim 121 of the outer compartment 116 it springs outwardly thereby preventing the inner member 118 from receding back within the outer member 116. Should the size of a golf club require that the compartment 112 be lowered, the latches 120 may be held by finger pressure and slid downwardly past the top rim 121 until the desired height between the inner and outer compartments is reached.

Figure 4:
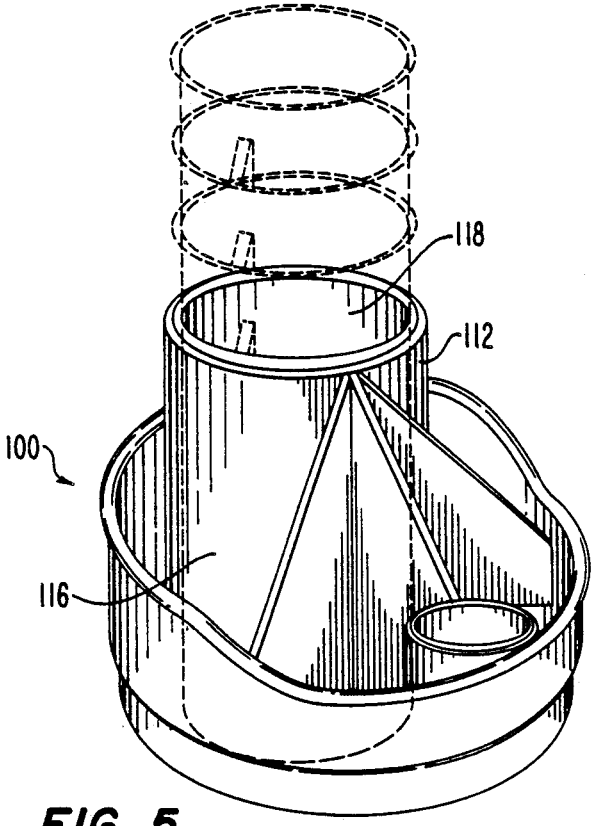
FIG. 4 is a perspective view of a second embodiment of the present invention.
Figure 7:
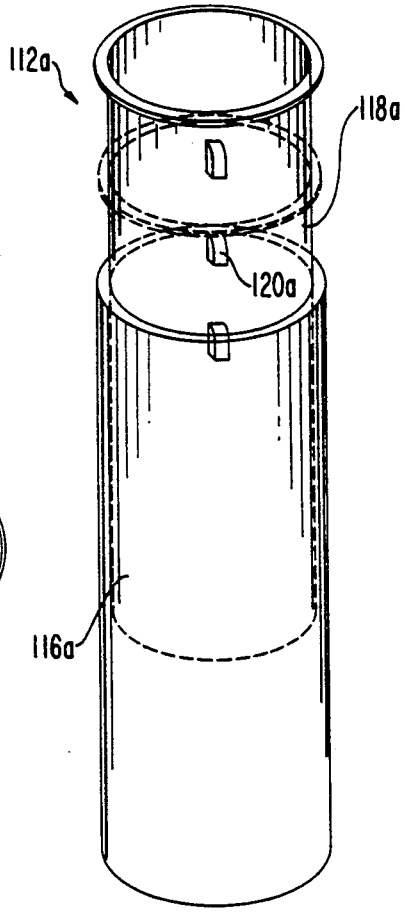
FIG. 7 is a perspective view of a detail of FIG. 4.
Figure 5:
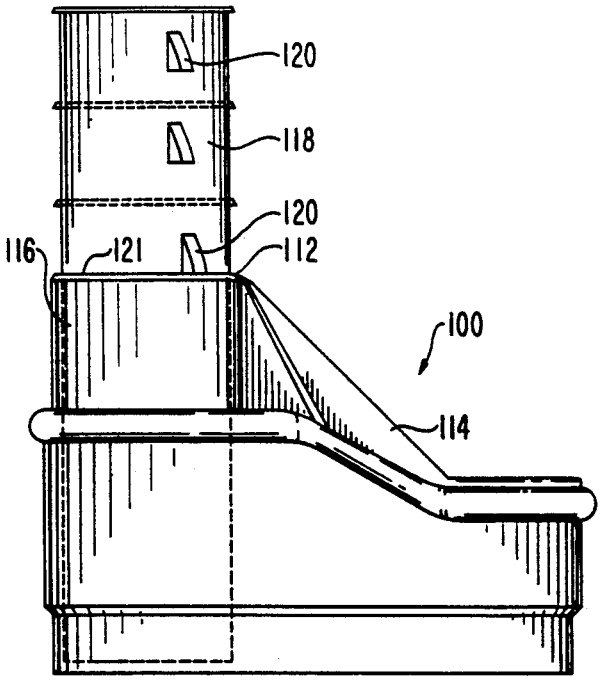
FIG. 5 is a side elevational view of FIG. 4.
Figure 6:
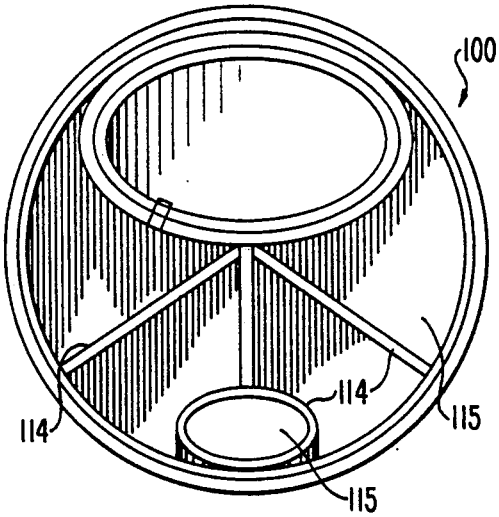
FIG. 6 is a top plan view of FIG. 4.
Figure 8:
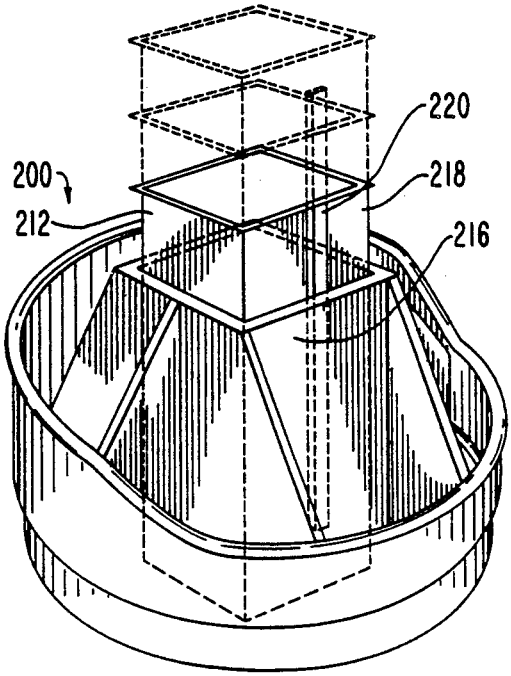
FIG. 8 is a perspective view of a third embodiment of the present invention.

The inner compartment in FIG. 4 is shown to be oval shaped. However, it will be appreciated that various other shapes may be used. For example, FIG. 7 illustrates a primary compartment 112A which is cylindrical in shape including an outer member 116A and inner member 118A and a series of spring latches 120A. FIG. 8 illustrates a third embodiment of a golf bag insert 200 of the present invention including a primary compartment 212 and a series of outer compartments 215 formed by a plurality of dividers 214. In this embodiment the primary compartment 212 is square and is formed by a fixed outer member 216 and an inner member 218 which is telescopically movable therein. The position between the telescoping elements 216 and 218 is infinitely adjustable using a pair of complementary magnetic strips 220 which are disposed on the inside of the outer member 216 and the outside of inner member 218 respectively. The strength of the magnetic material is chosen so that the members may easily be moved with respect to each other but have sufficient attraction to maintain the telescoping members in a fixed position for the particular height of the golf clubs being stored during use although the bag is subject to rough handling during the play of a round of golf.

Figure 11:
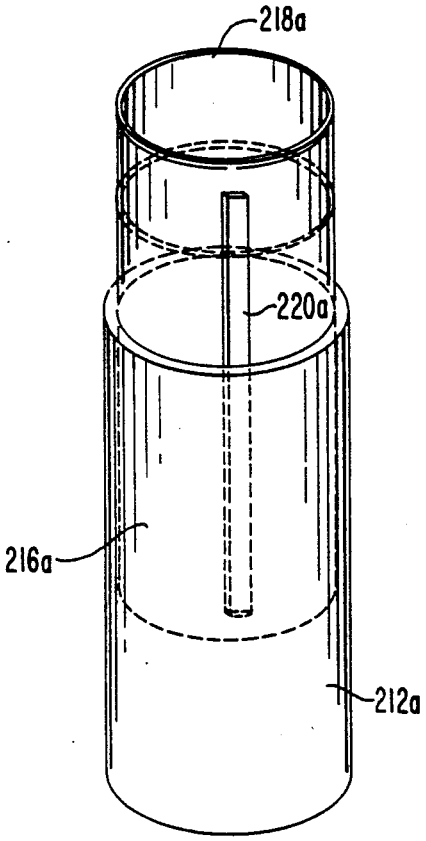
FIG. 11 is a view of a detail of FIG. 8.
Figure 9:
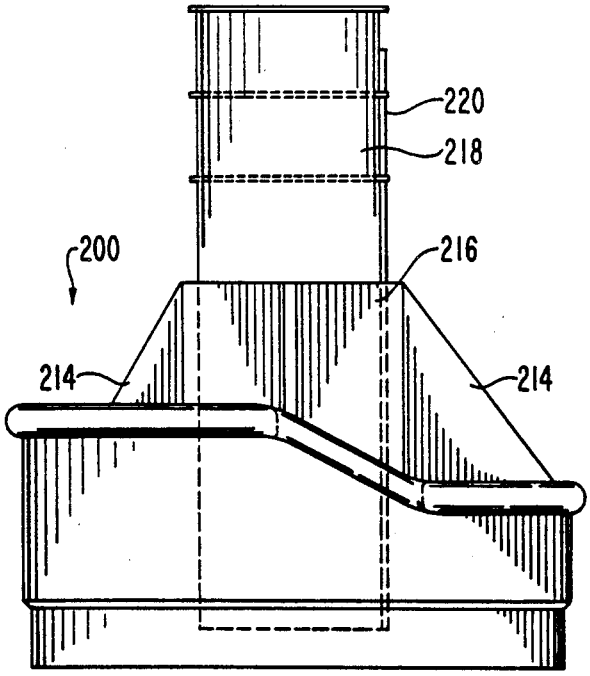
FIG. 9 is a side elevational view of FIG. 8.
Figure 10:
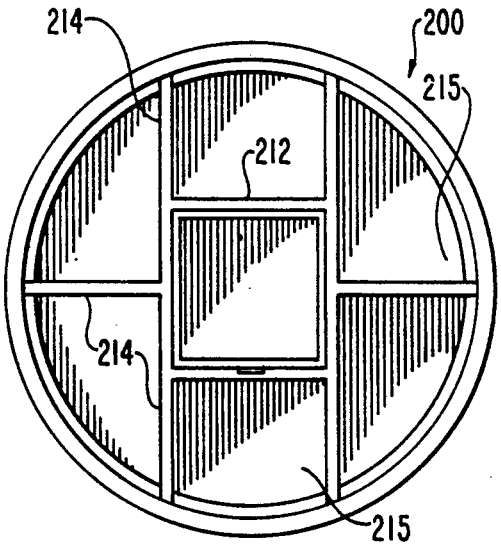
FIG. 10 is a top plan view of FIG. 8.

It will be appreciated that although the central compartment 212 is shown as generally square, it may be any conventional shape. For example, FIG. 11 shows a round member 212A formed by an outer fixed member 216A, an inner telescopically movable member 218A and magnetic strips 220A to hold the members together once a fixed position is selected.

Figure 12:
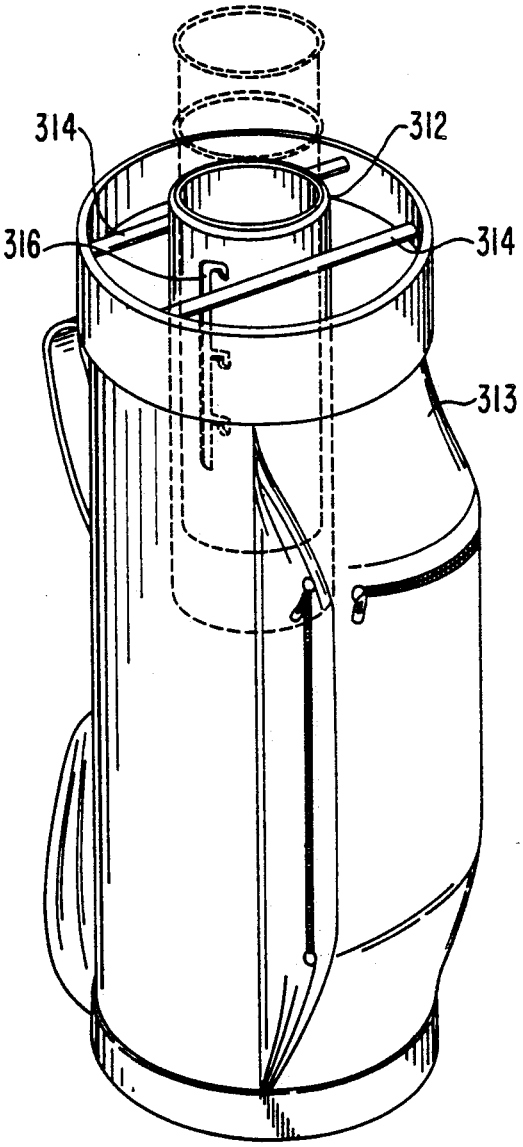
FIG. 12 is a perspective view of a fourth embodiment of the present invention.

FIG. 12 illustrates an embodiment of a golf club holder insert 312 within a conventional golf bag 313 in combination with a pair of dividers 314. Whereas the telescoping members forming the primary insert use a bayonet type latching means 316 of the type described in FIGS. 1–3, it will be appreciated that any of the various disclosed latching means may be used.

Figure 13:
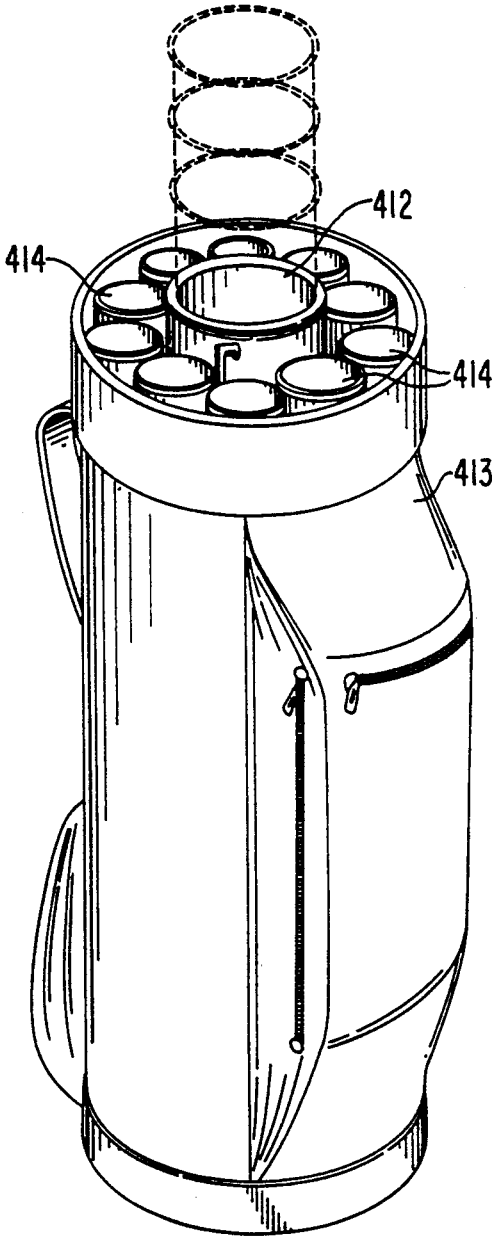
FIG. 13 is a perspective view of a fifth embodiment of the present invention.

FIG. 13 shows another embodiment of an insert 412 located in a golf bag 413 formed with a plurality of tubular dividers 414. Here again, any type of suitable latching means of the type described hereinabove between the telescoping members would be appropriate.

It will be appreciated that various changes and modifications may be made in the various structures described hereinabove. As indicated above, various shapes and sizes of compartments may be used along with various latching means to maintain the telescoping members in a desired selected position with respect to each other. Other modifications and changes may be made in keeping within the scope of the following claims.

I claim:

1. A gold club holder insert for use with a golf bag to hold a plurality of golf clubs of various lengths, the insert comprising:

an outer wall sized to fit within the opening of the golf bag;

a primary compartment disposed within said outer wall and structured to receive golf clubs, said compartment formed of a first vertically oriented outer member, and a second vertically oriented inner member including means for telescopic movement within said first outer member; movement of the first and second members adjusting the overall height of said primary compartment;

latching means to maintain said outer and inner members fixed with respect to each other; and a plurality of secondary compartments adjacent said primary compartment structured to receive additional golf clubs.

2. The insert of claim 1 wherein said latching means is a bayonet latch.

3. The insert of claim 2 wherein said bayonet latch includes an elongated slot and a plurality of notches on one of said members and a pin slidably movable within said slot and into said notches on another of said members.

4. The insert of claim 1 wherein said latching means includes a plurality of spring latches formed on said inner member and structured to engage an upper rim of said outer member thereby preventing movement between said members.

5. The insert of claim 1 wherein said latching means includes magnetic elements complementarily disposed on said inner and outer members.

6. The insert of claim 1 wherein said primary compartment is centrally located on said insert and said secondary compartments are located between said primary compartment and said outer wall.

7. A golf club holder insert for use with a golf bag to hold a plurality of golf clubs of various lengths, the insert comprising:

an outer wall sized to fit within the opening of the golf bag;

a primary compartment disposed within said outer wall and structured to receive golf clubs, said compartment formed of a first vertically oriented outer member, and a second vertically oriented inner member including means for telescopic movement within said first outer member; movement of the first and second members adjusting the overall height of said primary compartment;

a bayonet latch, to maintain said outer and inner members fixed with respect to each other, said latch including an elongated slot and a plurality of notches on one of said members, and a pin slidably movable within said slot and into said notches on another of said members; and a plurality of secondary compartments disposed between said primary compartment and said outer wall and structured to receive additional golf clubs.

8. A golf club holder insert for use with a golf bag to hold a plurality of golf clubs of various lengths, the insert comprising:

an outer wall sized to fit within the opening of the golf bag;

a primary compartment disposed within said outer wall and structured to receive golf clubs, said compartment formed of a first vertically oriented outer member, and a second vertically oriented inner member including means for telescopic movement within said first outer member; movement of the first and second members adjusting the overall height of said primary compartment;

a plurality of spring latches to maintain said inner and outer members fixed with respect to each other, said latches formed on said inner member and structured to engage an upper rim of said outer member; and a plurality of secondary compartments disposed between said primary compartment and said outer wall and structured to receive additional golf clubs.

9. A golf club holder insert for use with a golf bag to hold a plurality of golf clubs of various lengths, the insert comprising:

an outer wall sized to fit within the opening of the golf bag;

A primary compartment disposed within said outer wall and structured to receive golf clubs, said compartment formed of a first vertically oriented outer member, and a second vertically oriented inner member including means for telescopic movement within said first outer member; movement of the first and second members adjusting the overall height or said primary compartment;

magnetic latching means including complementary magnetic elements disposed on said inner and outer members to maintain said inner and outer membêrs fixed with respect to each other when the magnetic elements are aligned; and a plurality of secondary compartments disposed between said primary compartment and said outer wall and structured to receive additional golf clubs.

* * * * *